United States Patent [19]

Sankaranarayanan et al.

[11] Patent Number: 4,917,170

[45] Date of Patent: Apr. 17, 1990

[54] NON-PREHEATED LOW THERMAL CONDUCTIVITY SUBSTRATE FOR USE IN SPRAY-DEPOSITED STRIP PRODUCTION

[75] Inventors: Ashok Sankaranarayanan, Bethany; W. Gary Watson, Cheshire; Harvey P. Cheskis, North Haven, all of Conn.

[73] Assignee: Olin Corporation, Cheshire, Conn.

[21] Appl. No.: 246,845

[22] Filed: Sep. 20, 1988

[51] Int. Cl.[4] ..... B22D 23/00

[52] U.S. Cl. ..... 164/429; 164/46; 164/479

[58] Field of Search ..... 164/46, 463, 479, 423, 164/429; 427/422, 423, 383.5; 118/302

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.1 |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | |
|---|---|---|
| 0225732 | 6/1987 | European Pat. Off. . |
| 0225080 | 10/1987 | European Pat. Off. . |
| 1379261 | 2/1975 | United Kingdom . |
| 1472939 | 5/1977 | United Kingdom . |
| 2007129 | 5/1979 | United Kingdom . |
| 1548616 | 7/1979 | United Kingdom . |
| 1599392 | 9/1981 | United Kingdom . |
| 2172827 | 10/1986 | United Kingdom . |
| 2172900 | 10/1986 | United Kingdom . |

OTHER PUBLICATIONS

R. W. Evans et al, "The Osprey Preform Process", 1985, pp. 13–20 *Powder Metallurgy*, vol. 28, No. 1.

A. G. Leatham et al, "The Osprey process for the production of Spray-Deposited Roll, Disc, Tube and Billet Preforms", 1985, pp. 157–173, *Modern Developments in Powder Metallurgy*, vols. 15–17.

*Primary Examiner*—Kuang Y. Lin

*Attorney, Agent, or Firm*—H. Samuel Kieser

[57] ABSTRACT

A molten metal gas-atomizing spray-depositing apparatus has an atomizer which employs a pressurized gas flow for atomizing a stream of molten metal into a spray pattern of semi-solid metal particles. The apparatus also has a movable non-preheated substrate composed of a material having a predetermined thermal conductivity of about one or less (W/M−K) being disposed below the atomizeer. The substrate receives thereon a deposit of the particles in the spray pattern. The pressurized gas flow also impinges thereon for cooling the deposit on the substrate to form a product thereon. The predetermined thermal conductivity of the substrate of one or less precludes extraction of heat by the substrate from, and thus solidification of, the deposit upon initial contact with the substrate whereby a reduction of porosity is achieved in the deposit.

6 Claims, 1 Drawing Sheet

NON-PREHEATED LOW THERMAL CONDUCTIVITY SUBSTRATE FOR USE IN SPRAY-DEPOSITED STRIP PRODUCTION

BACKGROUND OF THE INVENTION

1. Field of the Invention

The present invention generally relates to spray-deposited production of a product on a moving substrate and, more particularly, is concerned with use of a non-preheated substrate composed of low thermal conductivity material for reducing product porosity.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R. W. Evans et al, *Powder Metallurgy,* Vol. 28, No. 1 (1985), pages 13–20 and "The Osprey Process for the Production of Spray-Deposited Roll, Disc, Tube and Billet Preforms" by A. G. Leatham et al, *Modern Developments in Powder Metallurgy,* Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a substrate or collector, such as a flat substrate or an endless belt, is moved continuously through the spray to receive a deposit of uniform thickness across its width.

Heretofore, extensive porosity typically has been observed in a spray-deposited preform at the bottom thereof (its side in contact with the substrate or collector). This phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between splattered droplets. In other words, when the semi-solid hot metal droplets hit the cool substrate, they transfer all of their heat and thus freeze before they can spread on the substrate and also before subsequent droplets arrive.

One approach of the prior art for reducing the porosity problem is preheating the substrate to minimize or reduce the rate of heat transfer from the initial deposit to the substrate so that rapid solidification of the droplets does not occur and some fraction liquid is always available to feed voids created during the spray deposition process. However, it is often difficult to effectively preheat a substrate in a commercial spray deposit system because of the cooling effects on the substrate of the high velocity re circulating atomizing gas.

Also, for wide width material, non-uniform heating of the substrate may occur which can lead to distortion of the substrate and the deposit and in extreme conditions may cause hot tearing of the deposit. In addition the probability of the deposit sticking or welding to the substrate increases with increasing preheat temperature. It is also important to note that other problems such as creep thermal fatigue, etc., of the substrate can arise if excessive preheat temperatures are required.

Therefore, a need exists for an alternative approach to elimination of the porosity problem particularly in thin gauge product produced by the above-described Osprey spray-deposition process.

SUMMARY OF THE INVENTION

The present invention provides a non-preheated low thermal conductivity substrate designed to satisfy the aforementioned needs. In the approach of the present invention to solving the porosity problem, no preheating of the substrate is required.

Instead, heat extraction to achieve solidification of the deposit is due solely to the cooling effects of atomizing gas flow over the deposit. Since the substrate does not have to extract heat, the porosity problem can be minimized if the substrate thermal conductivity (TC) is low. Materials having a thermal conductivity in the single digit range, as measured in watts per meter per degree Kelvin (W/M−K), were found to be ideally suited for use as a non-preheated substrate for spray-deposited production of product, although materials of a thermal conductivity of fifteen or less may be used.

Accordingly, the present invention is directed to a molten metal gas-atomizing spray-depositing apparatus. The apparatus includes the combination of: (a) means employing a pressurized gas flow for atomizing a stream of molten metal into a spray pattern of semi-solid metal particles and producing a flow of the particles in the pattern thereof along with the gas flow in a generally downward direction; and (b) a non-preheated substrate composed of a material having a thermal conductivity of about fifteen or less (W/M−K), and preferably one or less (W/M−K), disposed below the atomizing means for receiving thereon a deposit of the particles in the spray pattern and for impinging thereon of the pressurized gas flow for cooling the deposit on said substrate to form a product thereon. The predetermined thermal conductivity of the substrate of about one or less precludes too rapid an extraction of heat by the substrate from, and thus solidification of, the deposit upon initial contact with the substrate whereby a reduction of porosity is achieved in the deposit.

Many glass types of materials, such as Vycor, glasses, Pyrex, glass-ceramics, etc., have thermal conductivities in a single digit range that meets the requirement of the present invention. An added advantage with these glass type materials is that they do not react chemically with copper and have significantly different thermal coefficients of expansion (TCE) as compared to copper. Due to these properties the deposits can readily be stripped from the substrate as a uniform flat product on cooling to low temperatures.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawing in which the single FIGURE is a schematic view, partly in section, of a spray-deposition apparatus for producing a product on a moving substrate, such as in thin gauge strip form, and useful in practicing the present invention.

DETAILED DESCRIPTION OF THE INVENTION

Prior Art Spray-Deposition Apparatus

Figure 1:
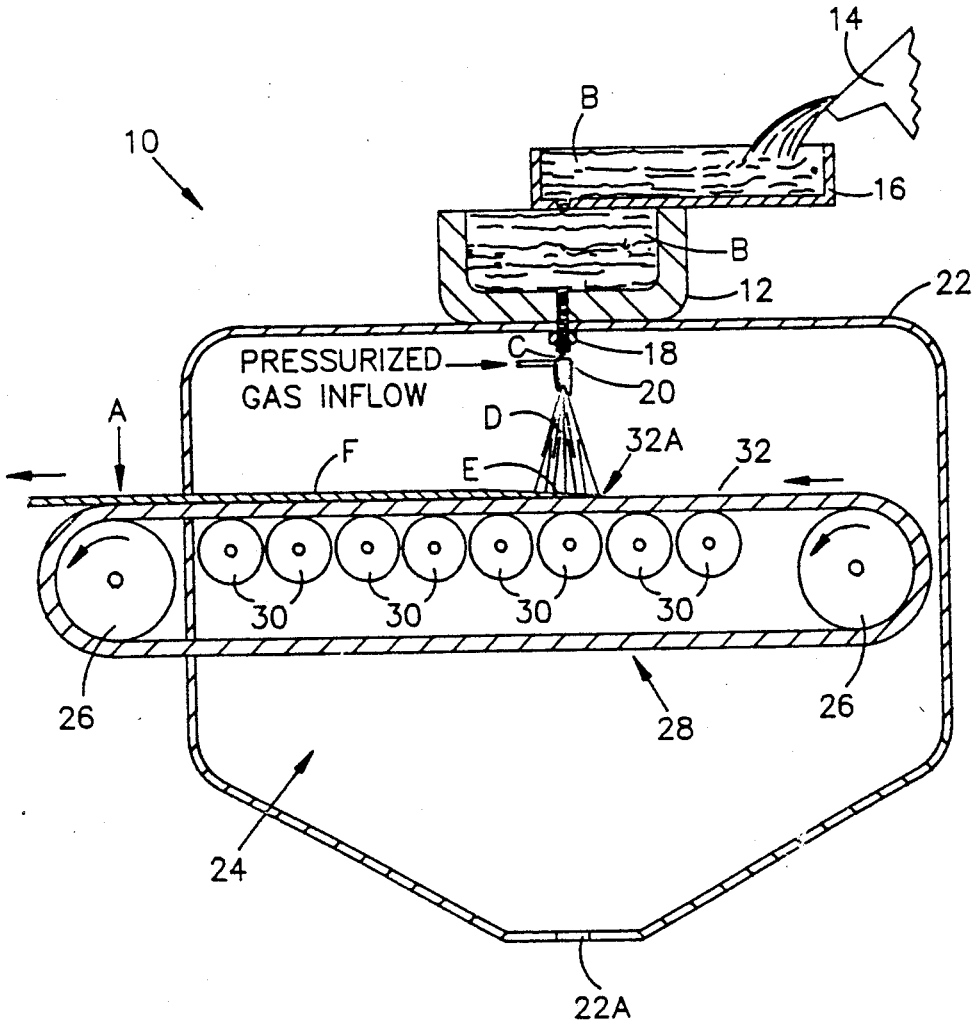

Referring now to the single FIGURE of the drawing, there is schematically illustrated a spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downward from the tundish 12.

Also, a gas atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles, broadcasting downward from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles over spray the substrate 28 and fall to the bottom of the spray chamber 22 where they along with the atomizing gas flow from the chamber via an exhaust port 22A.

Modifications of the Present Invention

In the prior art apparatus 10, the solid strip F formed on the substrate 28 typically exhibits extensive porosity in its bottom side adjacent the substrate. The cause of this porosity problem is believed to be due to contact with the cool substrate 28 which together with the impingement of the cool atomizing gas extracts too much heat and thereby lowers the temperature of the spray deposit E too rapidly, starving it of a sufficient fraction of liquid to feed the interstices between splattered droplets.

The solution of the present invention to the problem of deposit porosity is to provide a low thermal conductivity substrate. There is no additional requirement for preheating the substrate. Instead, heat extraction to achieve solidification of the deposit is due solely to the cooling effects of atomizing gas flow over the deposit.

Experimentation was conducted to determine the substrate thermal conductivity range over which a flat continuous deposit can be achieved. Molten copper was sprayed onto substrates with a range of different thermal conductivities. The results of this experimentation is given in Table I below.

The data indicates that a flat continuous deposit could be achieved only with low thermal conducting glass type materials such as Vycor, glasses, Pyrex, glass-ceramics, etc. Those materials having thermal conductivities (TC) in the one-tenth to one (W/M−K) range were ideally suited for use as a non-preheated substrate for spray-deposited production of product. However materials with a thermal conductivity of fifteen of less (W/M−K) may also be used. The experiments were repeated for spray casting of iron and the same trend was noted.

An added advantage with these glass type materials is that they do not react chemically with copper and have significantly different thermal coefficients of expansion (TCE) as compared to copper. Due to these properties the deposits can readily be stripped from the substrate as a uniform flat product on cooling to low temperatures.

TABLE I

| No. | Substrate Material | TC,W/M-K | Deposit Condition |
|---|---|---|---|
| 1 | Copper Block | 400 | Not Good |
| 2 | Aluminum Block | 230 | Not Good |
| 3 | Steel Block | 30 | Not Good |
| 4 | Alumina | 30 | Not Good |
| 5 | Silicon Nitride | 20 | Not Good |
| 6 | Glass (Soda-lime) | 0.1 | Good |
| 7 | Vycor[1] Glass | 1–0.1 | Good |
| 8 | Pyrex[2] Glass | 1–0.1 | Good |
| 9 | Corning Visions[3] | 1–0.1 | Good |

[1]A 96% silica glass produced by Corning Glass Works, Corning, N.Y., U.S.A.
[2]A borosilicate glass produced by Corning Glass, Corning, N.Y., U.S.A.
[3]A glass ceramic material produced by Corning Glass Works, Corning, N.Y., U.S.A.

The patent, patent application and publications set forth in this specification are intended to be incorporated by reference herein in their entirety.

While the invention has been described above with reference to specific embodiments thereof, it is evident that many alterations, modifications, and variations will be apparent to those skilled in the art in light of the foregoing description. Accordingly, it is intended to embrace all such alterations, modifications, and variations that fall within the spirit and broad scope of the applied claims.

We claim:

1. In a molten metal gas-atomizing spray-depositing apparatus, the combination comprising:

(a) means employing a pressurized gas flow for atomizing a stream of molten metal into a spray pattern of metal particles and producing a flow of said particles in said pattern thereof along with said gas flow in a generally downward direction;

(b) a non-preheated substrate composed of a material having a predetermined thermal conductivity of about fifteen or less (W/M−K) disposed below the atomizing means for receiving thereon a deposit of said particles in said spray pattern and for impinging thereon of said pressurized gas flow for cooling said deposit on said substrate to form a product thereon;

(c) said predetermined thermal conductivity of said substrate of about fifteen or less precluding extraction of heat by said substrate from, and thus solidification of said deposit upon initial contact with said substrate whereby a reduction of porosity is achieved in said deposit;

(d) means for moving said substrate relatively to said atomizing means; and (e) means for separating said deposit from said substrate located downstream of said atomizing means.

2. The apparatus as recited in claim 1, wherein said predetermined thermal conductivity is within a range of about one-tenth to one (W/M−K).

3. The apparatus as recited in claim 1, wherein said substrate is composed of a glass type material.

4. In a molten metal gas-atomizing spray-depositing apparatus, the combination comprising:

(a) means employing a pressurized gas flow for atomizing a stream of molten metal into a spray pattern of semi-solid metal particles and producing a flow of said particles in said pattern thereof along with said glas flow in a generally downward direction;

(b) a non-preheated substrate movable along a continuous path relative to said metal particles in said spray pattern thereof and being composed of a material having a predetermined thermal conductivity of about fifteen or less (W/M−k) disposed below the atomizing means for receiving thereon a deposit of said particles in said spray pattern and for impingement thereone of said pressurized gas flow for cooling said deposit on said substrate to form a product thereon;

(c) said predetermined thermal conductivity of said substrate of about fifteen or less precluding extration of heat by said substrate from, and thus solidification of said deposit upon initial contact with said substrate whereby a reduction of porosity is achieved in said deposit; and (d) means for separating said deposit from said substrate located downstream of said atomizing means.

5. The apparatus as recited in claim 4, wherein said predetermined thermal conductivity is within a range of about one-tenth to one W/M−K.

6. The apparatus as recited in claim 4, wherein said substrate is composed of a glass type material.

* * * * *

UNITED STATES PATENT AND TRADEMARK OFFICE

CERTIFICATE OF CORRECTION

PATENT NO. : 4,917,170

DATED : April 17, 1990

INVENTOR(S) : Sankaranarayanan Ashok, W. Gary Watson and Harvey P. Cheskis

It is certified that error appears in the above—identified patent and that said Letters Patent is hereby corrected as shown below:

On the title page of the patent, please delete the following:

[75] Inventors: Ashok Sankaranarayanan, Bethany; W. Gary Watson, Cheshire; Harvey P. Cheskis, North Haven, all of Conn.

and insert the following:

[75] Inventors: Sankaranarayanan Ashok, Bethany; W. Gary Watson, Cheshire; Harvey P. Cheskis, North Haven; all of Conn.

Abstract at line 8, after "the", delete "atomizeer" and insert --atomizer--.

At column 5, Claim 1, Section (d), line 1, after "substrate", delete "relatively" and insert --relative--.

At column 6, Claim 4, Section (a), line 5, after "said", delete "glas" and insert --glass--.

At column 6, Claim 4, Section (b), line 5, after "or less", delete "(W/M-k)" and insert --(W/M-K)--.

UNITED STATES PATENT AND TRADEMARK OFFICE

CERTIFICATE OF CORRECTION

PATENT NO. : 4,917,170

DATED : April 17, 1990

INVENTOR(S) : Sankaranarayanan Ashok, W. Gary Watson and Harvey P. Cheskis

It is certified that error appears in the above-identified patent and that said Letters Patent is hereby corrected as shown below:

At column 6, Claim 4, Section (b), line 8, after "impingement", delete "thereone" and insert --thereon--.

Signed and Sealed this

Twentieth Day of October, 1992

*Attest:*

DOUGLAS B. COMER

*Attesting Officer*

*Acting Commissioner of Patents and Trademarks*